US008109123B2

(12) United States Patent
Chen

(10) Patent No.: US 8,109,123 B2
(45) Date of Patent: Feb. 7, 2012

(54) RIVETING UNIT FOR ELECTRIC RIVET GUN

(75) Inventor: Hsin-Chi Chen, Taiping (TW)

(73) Assignee: Tranmax Machinery Co., Ltd., Taichung (TW)

( * ) Notice: Subject to any disclaimer, the term of this patent is extended or adjusted under 35 U.S.C. 154(b) by 295 days.

(21) Appl. No.: 12/631,863

(22) Filed: Dec. 7, 2009

(65) Prior Publication Data

US 2010/0139067 A1 Jun. 10, 2010

(30) Foreign Application Priority Data

Dec. 9, 2008 (TW) ..... 97147905 A

(51) Int. Cl.
*B21J 15/28* (2006.01)
*B23P 17/00* (2006.01)

(52) U.S. Cl. .... 72/21.1; 72/20.1; 72/391.4; 29/243.523; 29/243.525; 29/407.01

(58) Field of Classification Search ..... 72/20.1, 72/20.4, 21.1, 391.4; 29/407.1, 407.5, 524.1, 29/525.06, 243.521, 243.523, 243.524, 243.525
See application file for complete search history.

(56) References Cited

U.S. PATENT DOCUMENTS 6,892,431 B2 * 5/2005 Campbell et al. ..... 29/407.08
7,343,764 B2 * 3/2008 Solfronk ..... 72/20.1
7,503,196 B2 * 3/2009 Chitty et al. ..... 72/21.4
7,832,074 B2 * 11/2010 Stevenson et al. ..... 29/407.01

* cited by examiner

*Primary Examiner* — David Jones
(74) *Attorney, Agent, or Firm* — Pai Patent & Trademark Law Firm; Chao-Chang David Pai

(57) ABSTRACT

A riveting unit is assembled with an electric rivet gun, including a transmission unit, a clamping jaw having a locating portion driven by the transmission unit to be moveable between a first position and a second position, a first sensor detecting whether the locating portion of the clamping jaw is located at the first position, and a second sensor detecting whether the locating portion of the clamping jaw is located at the second position. When the locating portion of the clamping jaw is located at the first position, a blind rivet can be installed in the clamping jaw, and when the locating portion of the clamping jaw is located at the second position, the blind rivet can be ejected, and meanwhile the second sensor can allow the transmission unit to stop the movement of the clamping jaw, thereby preventing the clamping jaw from moving backwards excessively.

6 Claims, 6 Drawing Sheets

RIVETING UNIT FOR ELECTRIC RIVET GUN

BACKGROUND OF THE INVENTION

1. Field of the Invention

The present invention relates generally to an electric rivet gun, and more specifically to a riveting unit for an electric rivet gun that can prevent excessive backward movement of a clamping jaw for ensuring the normal operation of the electric rivet gun.

2. Description of the Related Art

A conventional electric riveter comprises a housing, a driving unit mounted in the housing, and a riveting unit having a transmission unit connected to the driving unit and a clamping jaw connected to the transmission unit. The clamping jaw can be driven to move forwards and backwards through the forward and backward rotation of the driving unit caused by a trigger, thereby attaining the purpose of ejecting a blind rivet.

However, the operation time of the driving unit is decided by holding the trigger, that is to say, if a user presses the trigger too short, the blind rivet can't be ejected, and if the user presses the trigger too long, the clamping jaw may be locked induced by its excessive backward movement, causing the breakdown of the riveting unit. Therefore, it is desirable to provide a riveting unit that can eliminate the aforesaid drawback.

SUMMARY OF THE INVENTION

It is one objective of the present invention to provide a riveting unit for an electric rivet gun that has a sensor to detect the movement of a clamping jaw for ensuring the normal operation of the electric rivet gun.

To achieve the above-mentioned objective of the present invention, the riveting unit comprises a transmission unit, a clamping jaw having a locating portion driven by the transmission unit to be moveable between a first position where a blind rivet can be installed in the clamping jaw, and a second position where the blind rivet can be ejected, a first sensor configured to detect whether the locating portion of the clamping jaw is located at the first position, and a second sensor configured to detect whether the locating portion of the clamping jaw is located at the second position.

Once the locating portion of the clamping jaw is moved from the first position to the second position, the second sensor can allow the transmission unit to stop the movement of the clamping jaw for preventing excessive backward movement of the clamping jaw and ensuring normal operation of the riveting unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
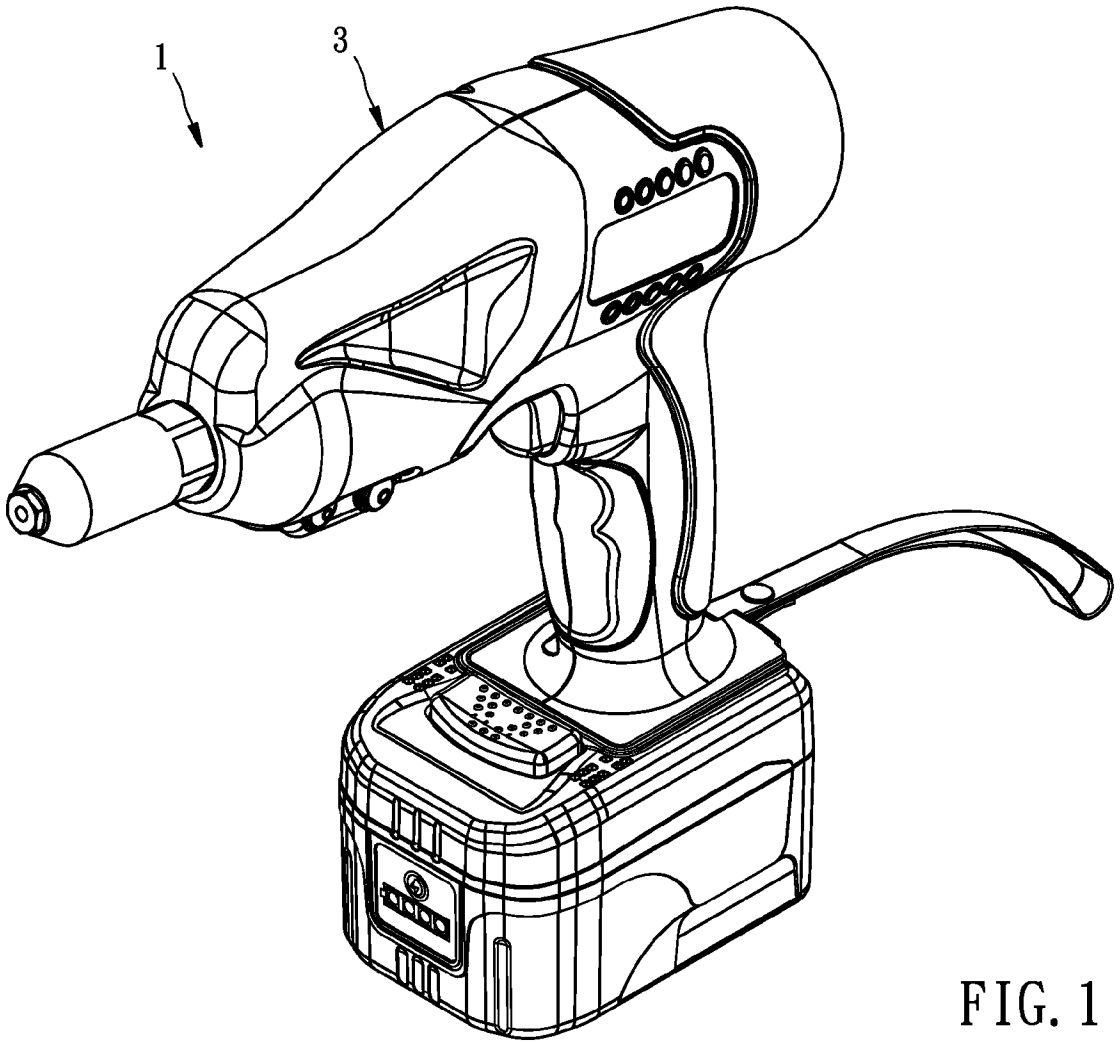
FIG. 1 is a perspective view of an electric rivet gun.
Figure 2:
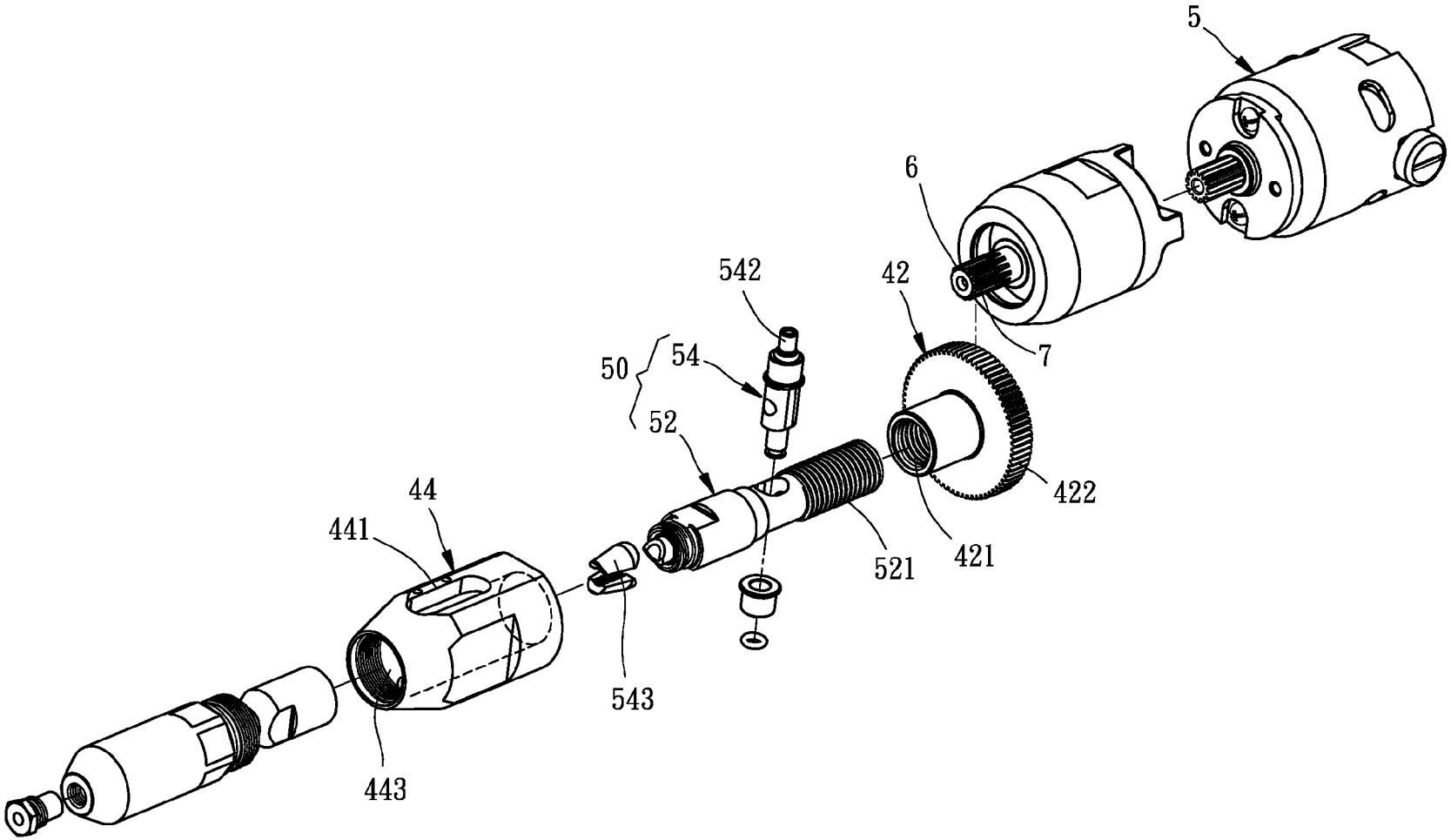
FIG. 2 is a partial exploded view of a riveting unit according to a preferred embodiment of the prevent invention.
Figure 3:
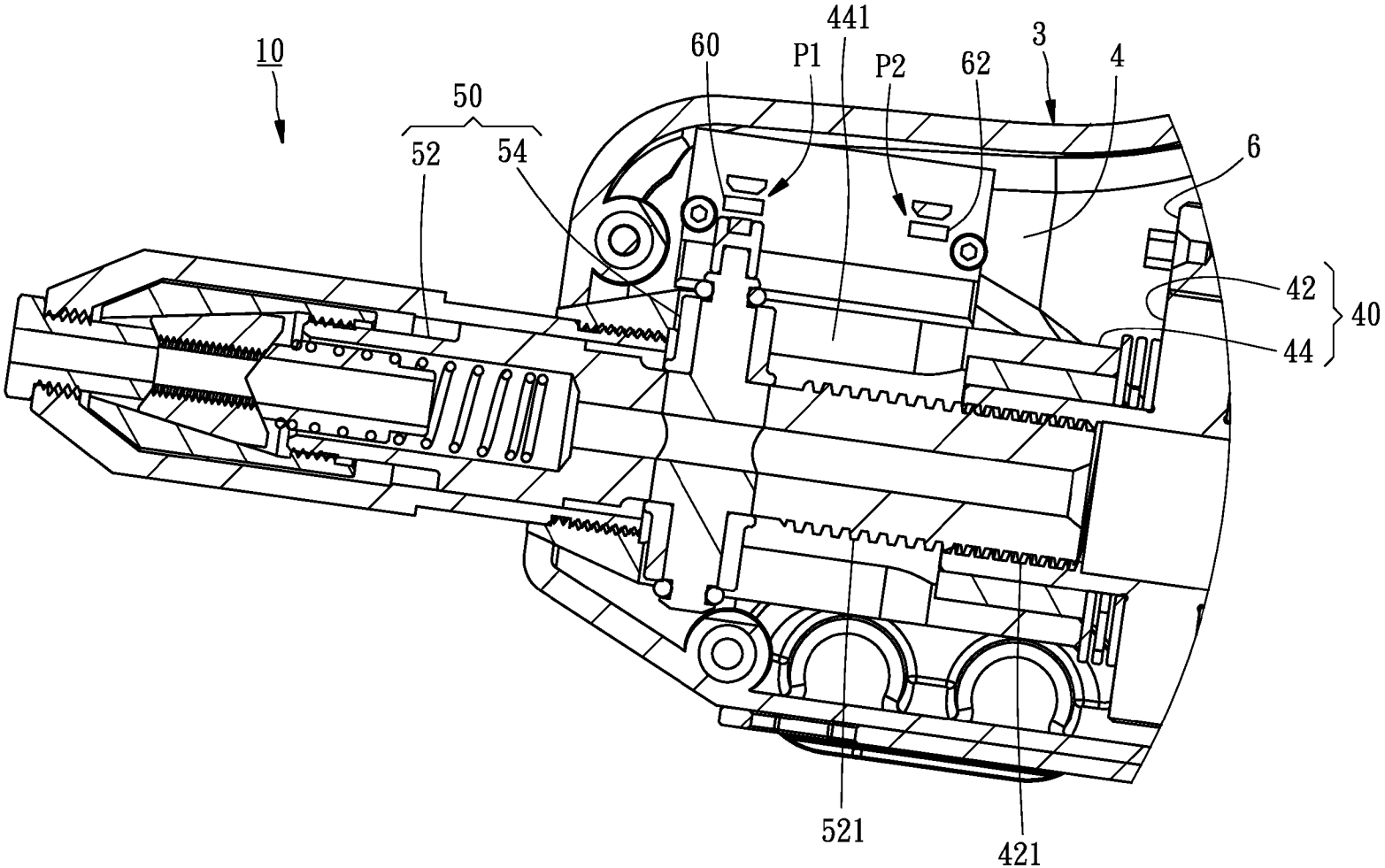
FIG. 3 is a sectional view of the riveting unit.

As shown in FIG. 1, a riveting unit 10 in accordance with a preferred embodiment of the present invention is installed in an electric rivet gun 1. Referring to FIGS. 1-3, the electric rivet gun 1 comprises a housing 3 having a chamber 4 therein, and a driving unit 5 installed in the camber 4 of the housing 3 and having a transmission shaft 6 with a first teeth portion 7. The riveting unit 10 comprises a transmission unit 40, a clamping jaw 50, a first sensor 60, and a second sensor 62.

As shown in FIGS. 2-3, the transmission unit 40 is disposed in the chamber 4 of the housing 3, and provided with a wheel 42 and a restricting member 44. The wheel 42 has a first threaded portion 421 at a middle thereof and a second teeth portion 422 engaged with the first teeth portion 7 of the driving unit 5 such that the wheel 42 can be driven to rotate by the forward and backward rotation of the driving unit 5. The restricting member 44 has a through hole 443 sleeved on the first threaded portion 421 of the wheel 42 for restricting an axial movement of the wheel 42 and allowing relative rotation between the wheel 42 and the restricting member 44, and an elongated slot 441 communicated with through hole 443. To deserve to be mentioned, the transmission unit 40 is not limited to be engaged with the driving unit 5 in a coaxial or non-coaxial manner.

As shown in FIG. 3, the clamping jaw 50 includes a moving rod 52 and a locating rod 54. The moving rod 52 is inserted into the through hole 443 of the restricting member 44 and has a jaw portion 523 at one end thereof for clamping a blind rivet 70, and a second threaded portion 521 at the other end thereof threaded with the first threaded portion 421 of the wheel 42 such that the moving rod 52 can be driven to be axially moved through the forward and backward rotation of the wheel 42. The locating rod 54 is perpendicularly connected to the moving rod 52 so as to be moveable between a first position P1 and a second position P2 through the axial movement of the moving rod 52, and provided with a locating portion 542 passing through the elongated slot 441 of the restricting member 44.

The first and second sensors 60 & 62 are disposed in the chamber 4 of the housing 3 and respectively configured to detect whether the locating rod 54 is located at the first and second positions P1 & P2. The first and second sensors 60 & 62 are selected from the group consisting of a contact switch and a non-contact switch, such as a limit switch, a Hall effect sensor, or a photoelectric switch. In this embodiment, each of the first and second sensors 60 & 62 is a Hall effect sensor that is actuated by a magnetic force generated by the locating portion 542 of the clamping jaw 50.

Figure 4:
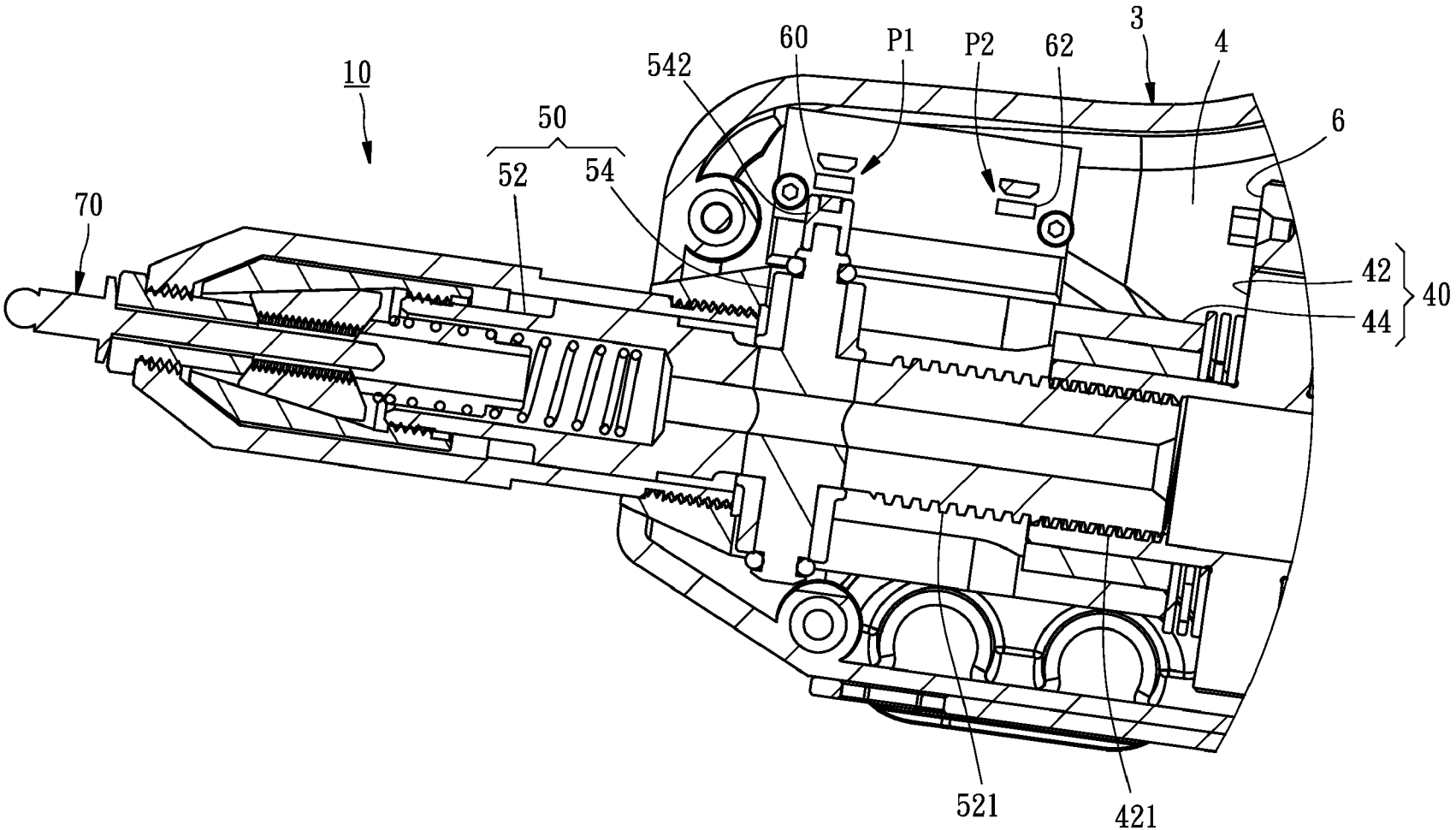
FIG. 4 is similar to FIG. 3, showing a blind rivet is installed.

As shown in FIGS. 3 and 4, when a user doesn't press a trigger (not shown) of the electric rivet gun, the locating rod 54 is located at the first position P1 where the jaw portion 523 of the clamping jaw 50 is opened to allow the installation of the blind rivet 70.

Figure 5:
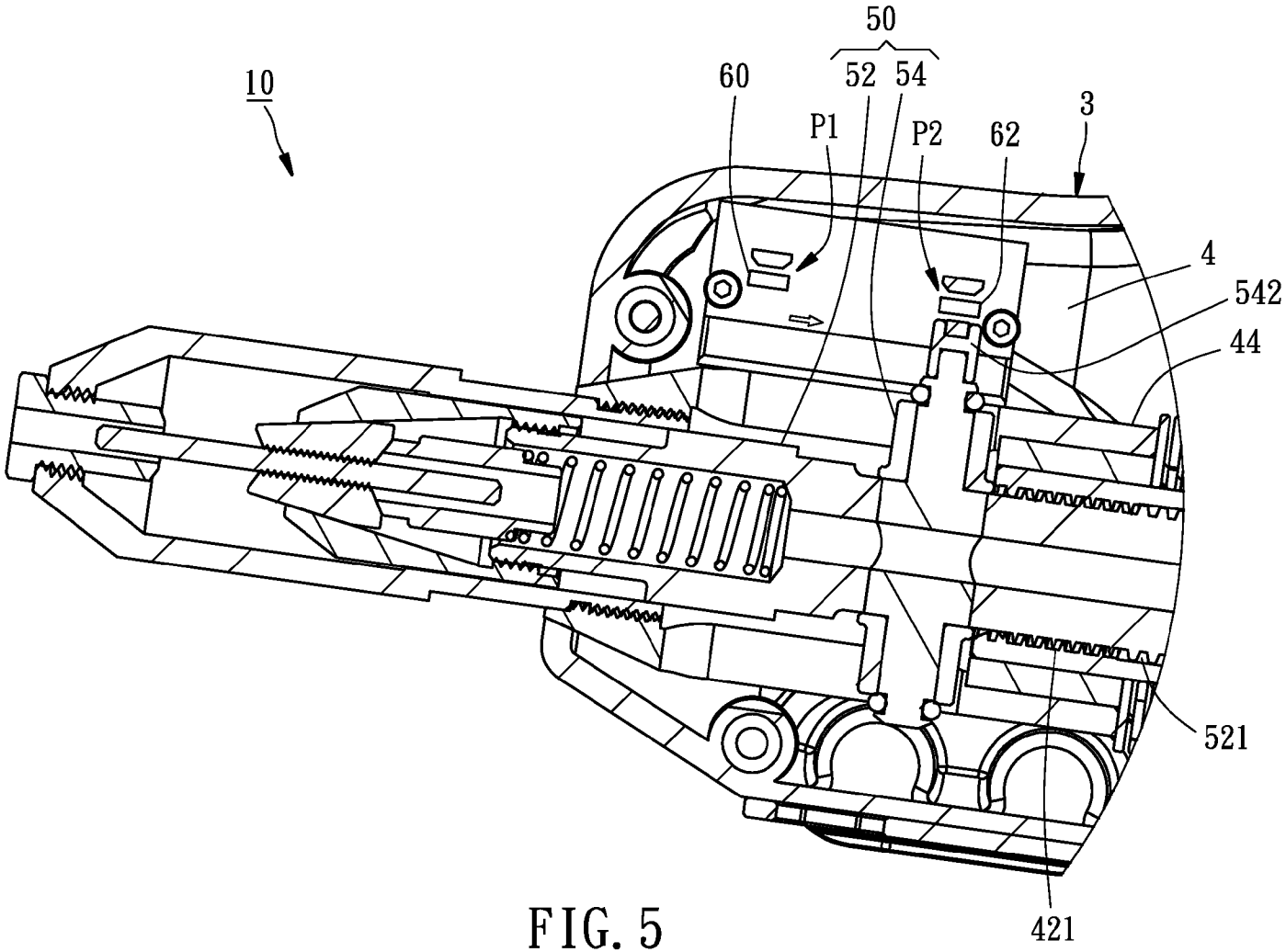
FIG. 5 is similar to FIG. 4, showing the clamping jaw is moved to the second position.
Figure 6:
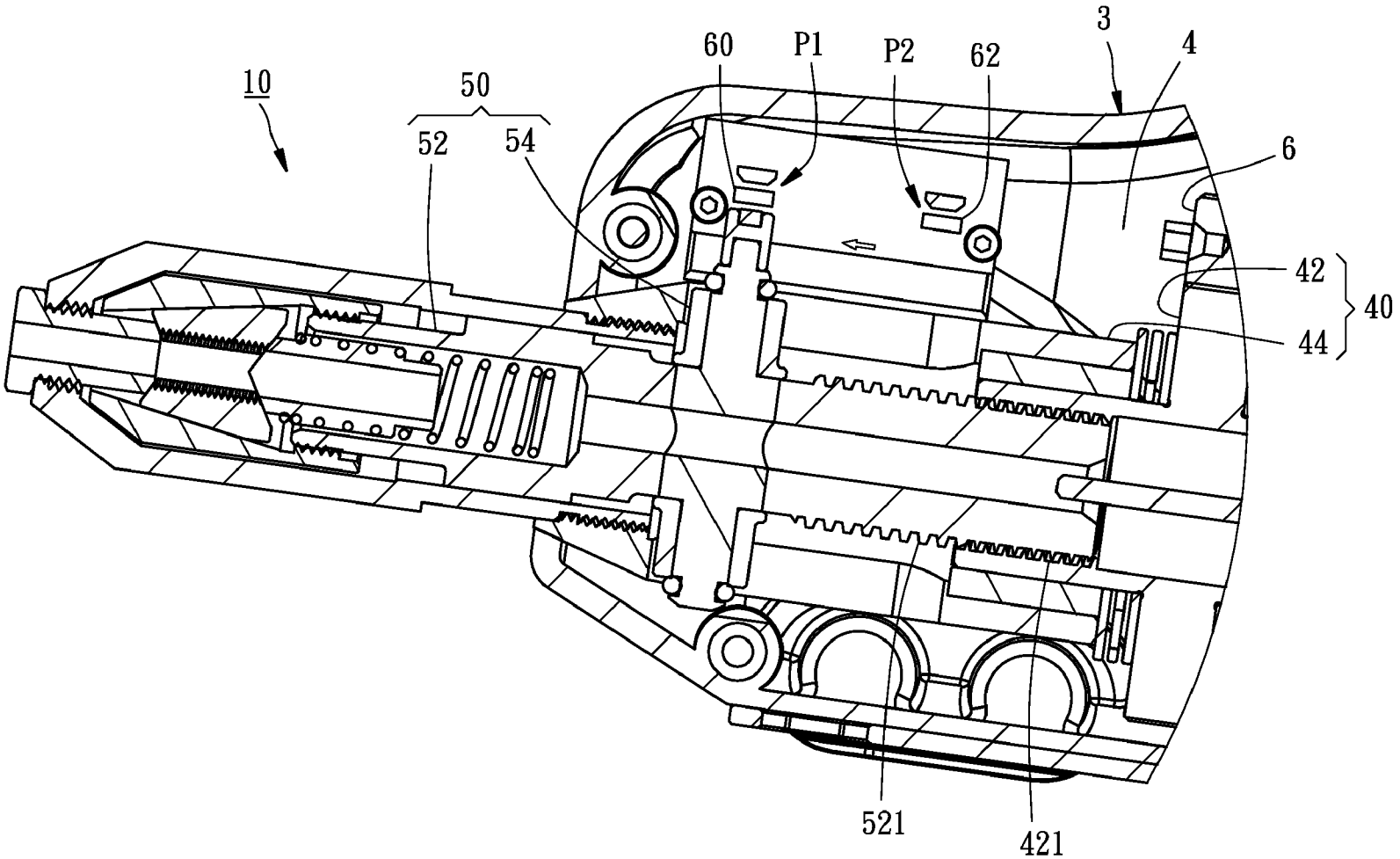
FIG. 6 is similar to FIG. 5, showing the clamping jaw is moved back to the first position.

As shown in FIGS. 5 and 6, when the user presses the trigger, the transmission unit 40 can be actuated by the driving unit 5 to move the clamping jaw 50 backwards such that the locating rod 54 can be moved from the first position P1 to the second position P2, and meanwhile the blind rivet 70 can be clamped and pulled by the clamping jaw 50. Once the locating rod 54 is moved to the second position P2, the blind rivet 70 can be ejected due to the break of a rivet stem of the blind rivet 70, and furthermore the second sensor 62 can allow the transmission unit 40 to stop the movement of the clamping jaw 50. Thereafter, the user can release the trigger to move the clamping jaw 50 back to the first position P1 through the backward rotation of the transmission unit 40 for the next ejection.

By means of the aforesaid, the riveting unit of the present invention provides two sensors that can detect the movement of the clamping jaw to prevent the clamping jaw from moving backwards excessively, thereby attaining the purpose of avoiding breakdown of the riveting unit and ensuring normal operation of the electric rivet gun.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A riveting unit comprising:

a transmission unit;

a clamping jaw having a locating portion driven by the transmission unit to be moveable between a first position where a blind rivet can be installed in the clamping jaw, and a second position where the blind rivet can be ejected;

a first sensor configured to detect whether the locating portion of the clamping jaw is located at the first position; and a second sensor configured to detect whether the locating portion of the clamping jaw is located at the second position, wherein when the second sensor detects the locating portion of the clamping jaw is located at the second position, the second sensor can allow the transmission unit to stop the movement of the clamping jaw.

2. The riveting unit as claimed in claim 1, wherein each of the sensors is selected from the group consisting of a contact switch and a non-contact switch.

3. The riveting unit as claimed in claim 2, wherein each of the sensors is selected from the group consisting of a limit switch, a Hall effect sensor, and a photoelectric switch.

4. The riveting unit as claimed in claim 1, wherein the transmission unit includes a restricting member and a wheel rotatably coupled to the restricting member, and the clamping jaw includes a moving rod inserted into the restricting member and movably connected to the wheel so as to be axially moveable relative to the wheel through the rotation of the wheel and, and a locating rod having the locating portion and connected to the moving rod so as to be movable between the first position and the second position through the axial movement of the moving rod.

5. The riveting unit as claimed in claim 4, wherein the wheel has a first threaded portion, and the moving rod has a second threaded portion threaded with the first threaded portion of the wheel.

6. The riveting unit as claimed in claim 4, wherein the restricting member has an elongated slot for penetration of the locating portion of the locating rod.

* * * * *